US007509821B1

(12) United States Patent
Lin et al.

(10) Patent No.: US 7,509,821 B1
(45) Date of Patent: Mar. 31, 2009

(54) YARN MEASURING DEVICE FOR FLAT BED KNITTING MACHINES

(75) Inventors: Yu-Sheng Lin, Taipei Hsien (TW); Joe Wang, Taipei Hsien (TW)

(73) Assignee: Pai Lung Machinery Mill Co., Ltd., Jui-Fang Town, Taipei Hsien (TW)

( * ) Notice: Subject to any disclaimer, the term of this patent is extended or adjusted under 35 U.S.C. 154(b) by 0 days.

(21) Appl. No.: 12/122,958

(22) Filed: May 19, 2008

(51) Int. Cl.
*D04B 15/48* (2006.01)

(52) U.S. Cl. ..... 66/125 R

(58) Field of Classification Search ..... 66/125 R, 66/126 R, 126 A, 127–130
See application file for complete search history.

(56) References Cited

U.S. PATENT DOCUMENTS 3,550,400 A * 12/1970 Peat et al. ..... 66/82 S
4,199,965 A * 4/1980 Wilson ..... 66/125 R
4,523,440 A * 6/1985 Voisin et al. ..... 66/146
4,574,598 A * 3/1986 Matthelie ..... 66/146
4,821,199 A * 4/1989 Kuhnert ..... 66/125 R
6,112,557 A 9/2000 Crabtree

* cited by examiner

*Primary Examiner*—Danny Worrell
(74) *Attorney, Agent, or Firm*—Muncy, Geissler, Olds & Lowe, PLLC

(57) ABSTRACT

A yarn measuring device for a flat bed knitting machine which has a chassis, a needle bed, a track and a carriage. The carriage has a cam controller and a mask plate. The yarn measuring device includes a counter, a detection unit and a programmable logic circuit controller. The programmable logic circuit controller, the counter, the detection unit, the carriage and the cam controller are electrically interconnected. Knitting stitches can be measured in a bidirectional fashion. Measuring accuracy improves, measured value can be read directly and easier, and the position of cams can be adjusted quickly. Total yarn requirement can be calculated accurately, fabric quality can be improved and production efficiency can be enhanced.

4 Claims, 7 Drawing Sheets

YARN MEASURING DEVICE FOR FLAT BED KNITTING MACHINES

FIELD OF THE INVENTION

The present invention relates to a yarn measuring device and particularly to a yarn measuring device for flat bed knitting machines.

BACKGROUND OF THE INVENTION

In textile industry, a key factor to maintain consistent quality of fabrics produced by each flat bed knitting machine is controlling the size of stitches knitted through yarns. The size of the stitches is formed by the amount of the yarns latched by needles. When there is a need to produce a great amount of one type of fabrics, the stitch formed by each flat bed knitting machine must be controlled at the same size whenever possible. In the event that the stitches of fabrics produced by different flat bed knitting machines are different, the cams driving the needles to perform yarn latching operation have to be adjusted. However, the size of the stitches is difficult to differentiate by people's naked eyes. Hence scientific measuring devices are needed to perform the task. Namely, by measuring yarn utilization during operation of the flat bed knitting machines, the stitch differences among the flat bed knitting machines can be compared and determined. Then the up and down positions of the cams of the flat bed knitting machines can be adjusted to stabilize fabric quality.

One of references to meet the purpose set forth above is U.S. Pat. No. 6,112,557 entitled "Flat bed yarn measuring device and method". Referring to FIGS. 1, 2 and 3 of that patent, the device adopts a technique in which a yarn 17 first drives a wheel 19 rotating when the flat bed knitting machine is operating. An electrically connected logic circuit control box 21 is provided to receive rotational signals generated by the wheel 19. There is a sensor 24 located on a carriage 10 above needle beds 13 and 14 that is movable on a track 15; and movement thereof can be detected by a home magnet 26, a first magnet 27 and a second magnet 28 that are fixedly mounted onto a stationary bar 25 and spaced from one another at a selected distance to generate respectively a reset signal, a start signal and a stop signal. These signals are received by the logic circuit control box 21 through the electrically connected sensor 24, so that the logic circuit control box 21 is reset to zero, and a statistical start point and a statistical stop point of the rotational signals generated by the wheel 19 can be controlled. For instance, given a 12 cut flat bed knitting machine, namely there are 12 needles for each inch on the flat bed knitting machine, to allocate 100 needles at a selected distance about 8.33 inches (or 21.1 cm for the metric system) is needed between the first magnet 27 and the second magnet 28, and the home magnet 26 is located outside the selected distance close to the first magnet 27. When the flat bed knitting machine starts operation, the carriage 10 first drives the sensor 24 to the home magnet 26 to be detected and reset to zero. Meanwhile, the yarn 17 drives in advance the wheel 19 to generate a rotational signal sent to the logic circuit control box 21. But the logic circuit control box 21 dose not start receiving and counting the rotational signal. When the carriage 10 continuously moves close to the first magnet 27, the sensor 24 detects and generates a signal to the logic circuit control box 21, then the logic circuit control box 21 starts receiving and accumulating the rotational signal generated by the wheel 19. When the carriage 10 continuously moves to the second magnet 28 for the selected needle distance (about 21.1 cm for 100 needles), the sensor 24 detects again and generates another signal to the logic circuit control box 21, and the logic circuit control box 21 stops receiving and accumulating the rotational signal generated by the wheel 19. Then the machine can be stopped to see a display 42 of the logic circuit control box 21. The logic circuit control box 21, through the radius (r) derived by the distance between the preset center of the wheel 19 and the contact circumference of the yarn 17, or a circumferential length entered in advance (through equation: $L=2\pi r$, circumference index $\pi=3.1416$) and accumulating received amount of the rotational signal of the wheel 19, total used amount of the yarn 17 at the selected distance of the needles (i.e. 100 needles) can be calculated (i.e. circumferential length×accumulating received amount through the rotational signal). Or yarn consumption of each needle can be obtained by dividing with 100. Hence the size of the stitch can be compared and determined. Thereby the up and down movement of the cams can be adjusted.

However, the conventional yarn measuring device mentioned above still has drawbacks in practice, notably:

1. The conventional yarn measuring device previously discussed can measure only in one direction. The home magnet 26 has to be reset to zero before starting receiving the rotational signal. Based on technical perspective, removing the home magnet 26 or adding another home magnet 26 close to the second magnet 28 still cannot easily perform bidirectional measurement. Without the home magnet 26 resetting to zero, the logic circuit control box 21 will do accumulation endlessly, and a desired measured value cannot be calculated and obtained. But adding the home magnet 26 beyond two ends of the first magnet 27 and second magnet 28, after the sensor 24 has detected the first magnet 27 and the logic circuit control box 21 starts accumulation, and at the instant the sensor 24 also detects the second magnet 28 and accumulation is stopped, the logic circuit control box 21 is reset to zero by the home magnet 26 close to the second magnet 28 before process is started. Hence the process is suspended. As a result, the measuring device has to reset the home magnet 26 to zero before performing each measurement. This one way measurement causes many disadvantages. For instance, the cam on the carriage to drive the needles in the forward movement is different from the one in the backward movement. As the cams have allowances during fabrication, and tolerances also exist during assembly, measurement of yarn consumption during the forward movement can be obtained to adjust the cam, but measurement of the backward movement can not be obtained and adjustment of the cam cannot be done. As a result, different sizes of fabric stitches will be formed.

2. The error range of the measured value of the conventional yarn measuring device is too great. Due to the yarn 17 is fed constantly during operation of the flat bed knitting machine, friction occurs between the circumferential surface of the wheel 19 and the yarn 17, and the yarn 17 drives the wheel 19 rotating. As previously discussed, the yarn consumption can be measured by the rotational times of the wheel 19, the error range of the measure value depends on the circumferential length of frictional contact between the wheel 19 and the yarn 17, or the radius that determines the circumferential length of the wheel 19. As the length of frictional contact between the yarn 17 and the circumference of the wheel 19 is not sufficient, sliding could occur and driving of the wheel 19 could be not possible. In such an occasion, the measured value has little meaning. To prevent such a phenomenon from occurring, the length of frictional contact between the yarn 17 and the circumference of the wheel 19 has to be increased, namely the circumference or radius of the wheel 19 has to be greater. But increasing the circumference of the wheel 19 also makes the error range of the measured value greater. As measurement of yarn consumption is calculated by the rotational times of the wheel 19, when the wheel 19 rotates close to one time but not exactly one time, an error occurs to the measured yarn consumption at that time. In the conventional technique, no matter how much the circumference of the wheel is reduced, the error range of the measured value still is too large. For instance, given a minimum wheel radius of 0.25 cm as a reasonable and practical value, the circumferential length is about 1.57 cm, and the measured value error range is about 0 to 1.56 cm. Namely the maximum error value is about 1.56 cm. With the error value at such a size, the accuracy is not desirable.

3. Reading of the measured value of the conventional yarn measuring device is difficult. As the logic circuit control box 21 is located on the carriage 10, and the display 42 is located on the logic circuit control box 21, reading the process result displayed on the display 42 has to be waited until the carriage 10 has finished moving. It is inconvenient for users.

4. Adjustment of the cams on the conventional yarn measuring device is tedious. As reading of the process result on the logic circuit control box 21 can be done only after the carriage 10 has stopped moving, then the cams can be adjusted in a still manner. After adjustment, the process result can only be obtained by reading the logic circuit control box 21 after the carriage 10 has stopped moving again, then another adjustment of the cams can be made. It is a tedious operation. Such a device that does not allow the process result to be directly read while the carriage is moving and the cams to be adjusted quickly and dynamically cannot meet the present market requirement.

SUMMARY OF THE INVENTION

Therefore, the primary object of the present invention is to provide a yarn measuring device for flat bed knitting machines that can measure stitches in a bidirectional fashion, improve measuring accuracy, allow direct reading of measured values and facilitate fast adjustment of cam position to accurately calculate total required amount of yarn consumption, improve fabric quality and increase production efficiency.

To achieve the foregoing object, the yarn measuring device according to the invention is installed on a flat bed knitting machine. The flat bed knitting machine has a chassis, a needle bed located horizontally on the chassis, a track located above the needle bed and in parallel therewith, and a carriage straddled the track and movable horizontally thereon. The carriage has two ends each has a cam controller located thereon and a mask plate located at one end. The yarn measuring device includes a counter located on the chassis close to a distal end of the track. The counter has an axial grating wheel with a plurality of apertures formed thereon in a circular array and equally spaced from one another, and an U-shaped sensor. The grating wheel is extended between two ends of the sensor. The yarn measuring device also has a detection unit located on the chassis in parallel with the needle bed and opposing the mask plate. The detection unit is formed in an U shape and has a first sensor and a second sensor spaced from each other at a selected distance. The yarn measuring device further has a programmable logic circuit controller located at one side of the chassis. The programmable logic circuit controller has a processor, a display and a programmable control interface that are electrically interconnected. The programmable logic circuit controller, counter, sensor, carriage and cam controller also are electrically interconnected.

The yarn measuring device thus formed provides many benefits, notably:

1. It can measure in a bidirectional fashion.
2. It has a smaller error range on the measured value.
3. It allows direct reading of the measured value during operation.
4. It allows the cam position to be adjusted quickly and easily during operation.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT AND OPERATION OF THE INVENTION

The present invention provides a yarn measuring device and particularly to a yarn measuring device for a flat bed knitting machine.

Figure 6:
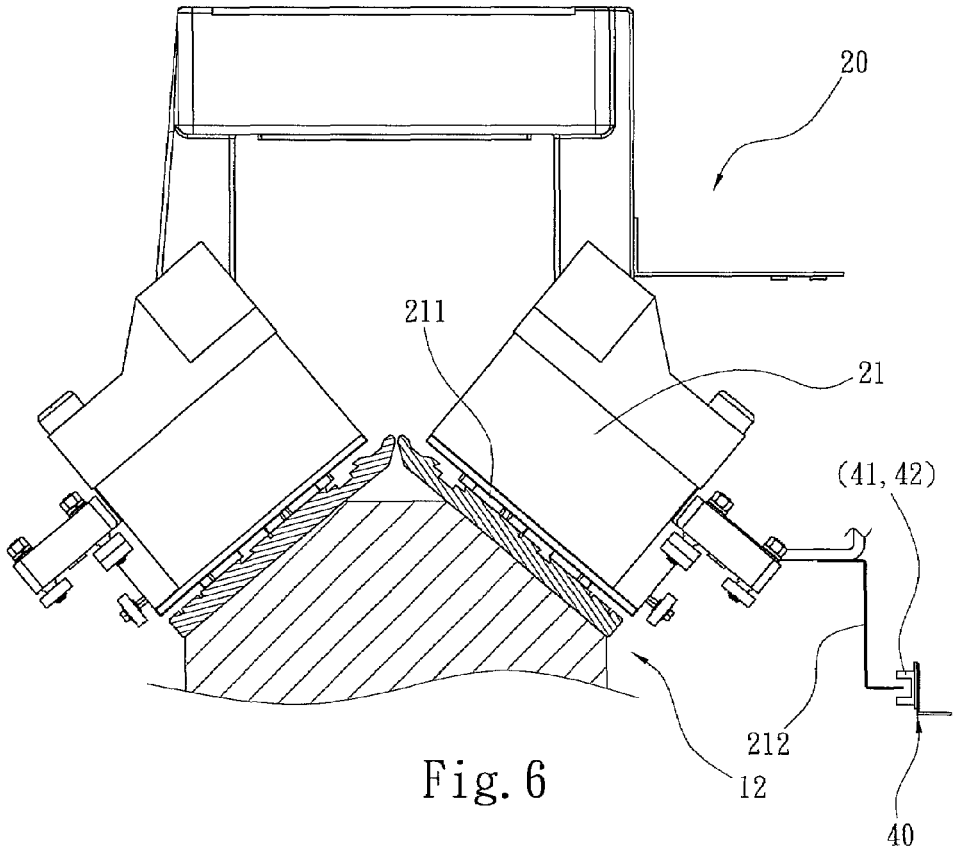
FIG. 6 is a schematic view of the relative position of the mask plate and detection unit of the invention.
Figure 7A:
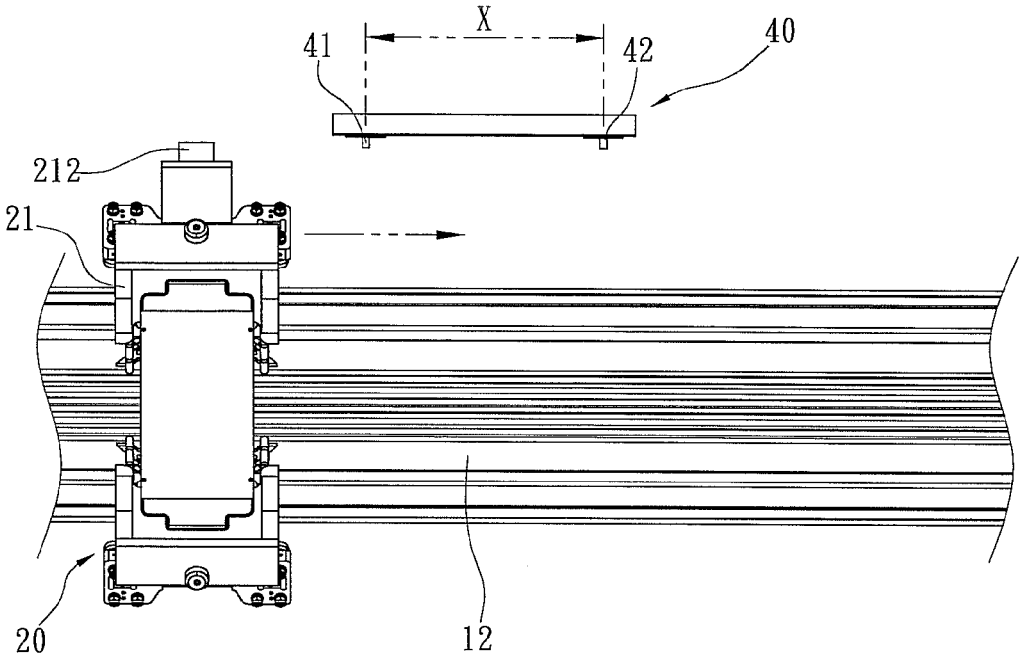
FIG. 7A is a schematic view of the mask plate and detection unit in operating condition-1.
Figure 7B:
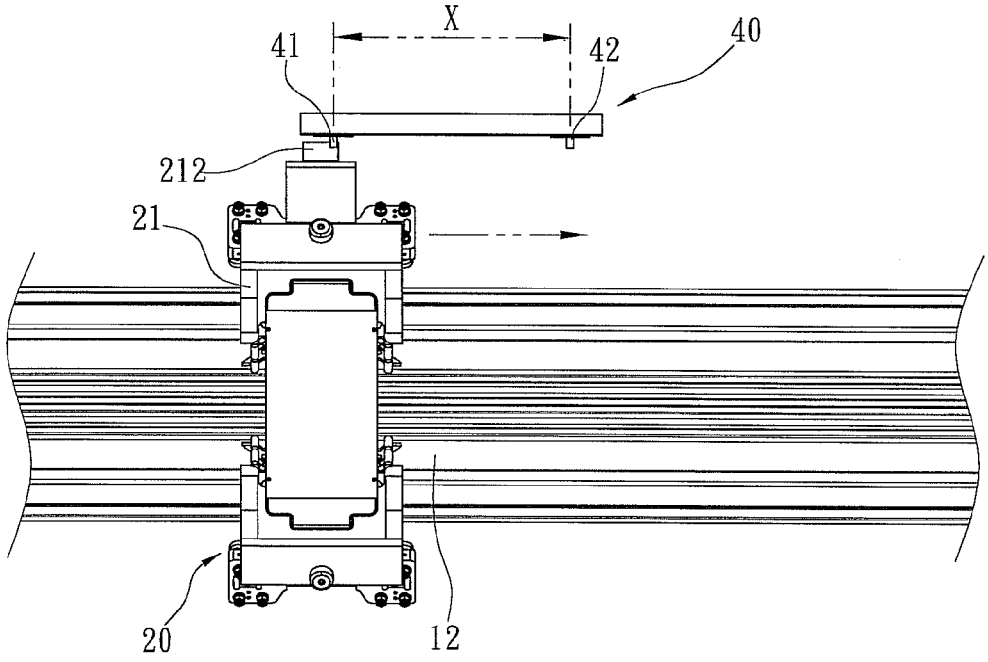
FIG. 7B is a schematic view according to FIG. 7A in operating condition-2.
Figure 7C:
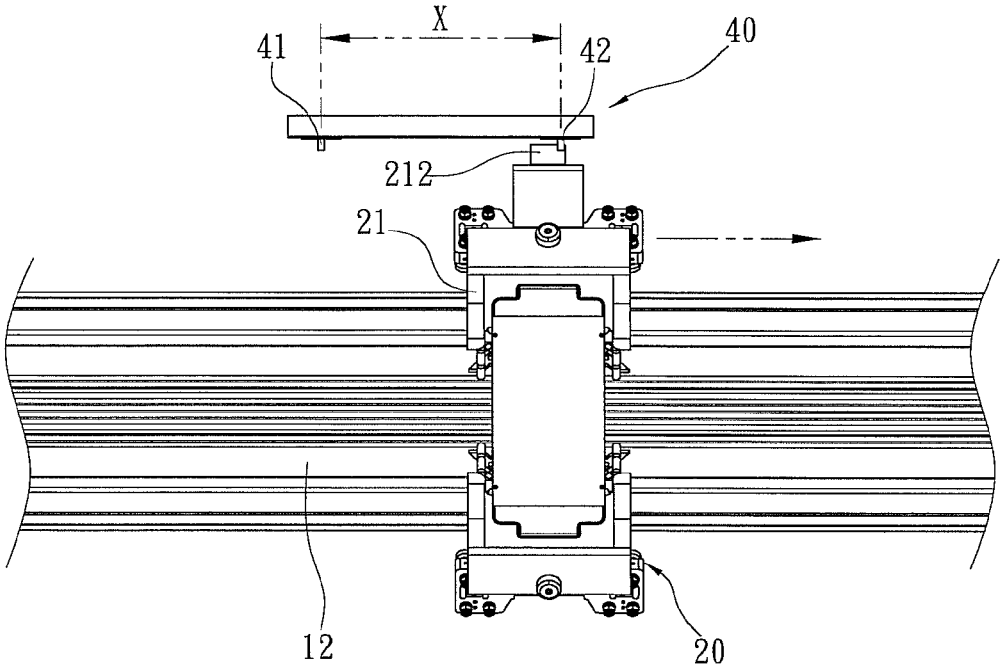
FIG. 7C is a schematic view according to FIG. 7B in operating condition-3.
Figure 7D:
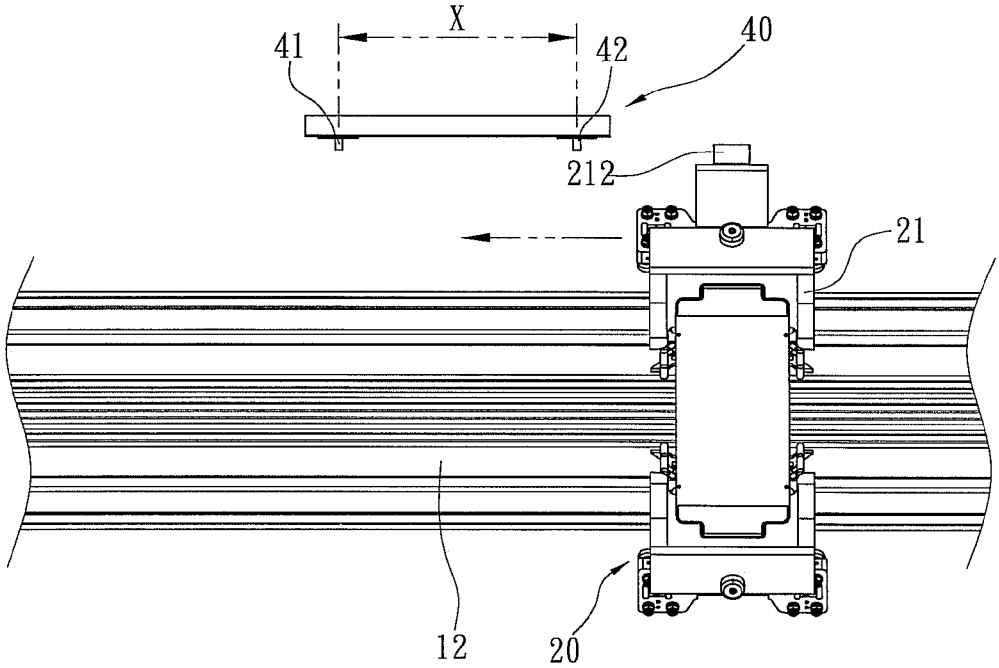
FIG. 7D is a schematic view according to FIG. 7C in operating condition-4.

Referring to FIGS. 1A, 1B, 2, 3, 5 and 6, the flat bed knitting machine 10 has a chassis 11, a needle bed 12 located horizontally on the chassis 11, a track 13 located above the needle bed 12 and in parallel therewith, and a carriage 20 straddled the track 13 and movable horizontally thereon. The carriage 20 has two ends each fastens to a cam controller 21 with cams 211 located thereon, as shown in FIG. 6 in which a plurality of cams are located at a lower side of the cam controller 21, and a mask plate 212 located at one end. The yarn measuring device includes a counter 30 located on the chassis 11 close to a distal end of the track 13. The counter 30 has an axial grating wheel 32 with a plurality of apertures 321 formed thereon in a circular array and equally spaced from one another, and an U-shaped sensor 33. The grating wheel 32 has a primary wheel 31 and two ancillary wheels 34 at two sides thereof in a symmetrical manner. The grating wheel 32 is extended between two ends of the sensor 33. The chassis 11 further has a yarn dispenser 14 located thereon between the chassis 11 and the counter 30, and a detection unit 40 in parallel with the needle bed 12 and opposing the mask plate 212. The detection unit 40 has a first sensor 41 and a second sensor 42 that are formed in an U shape and spaced from each other at a selected distance X (referring to FIGS. 7A and 7B). The chassis 11 further has a programmable logic circuit controller 50 at one side. The programmable logic circuit controller 50 has a processor 51, a display 52 and a programmable control interface 53 that are electrically interconnected (not shown in the drawings). The programmable logic circuit controller 50, counter 30, detection unit 40, carriage 20 and cam controller 21 also are electrically interconnected (not shown in the drawings).

Figure 1A:
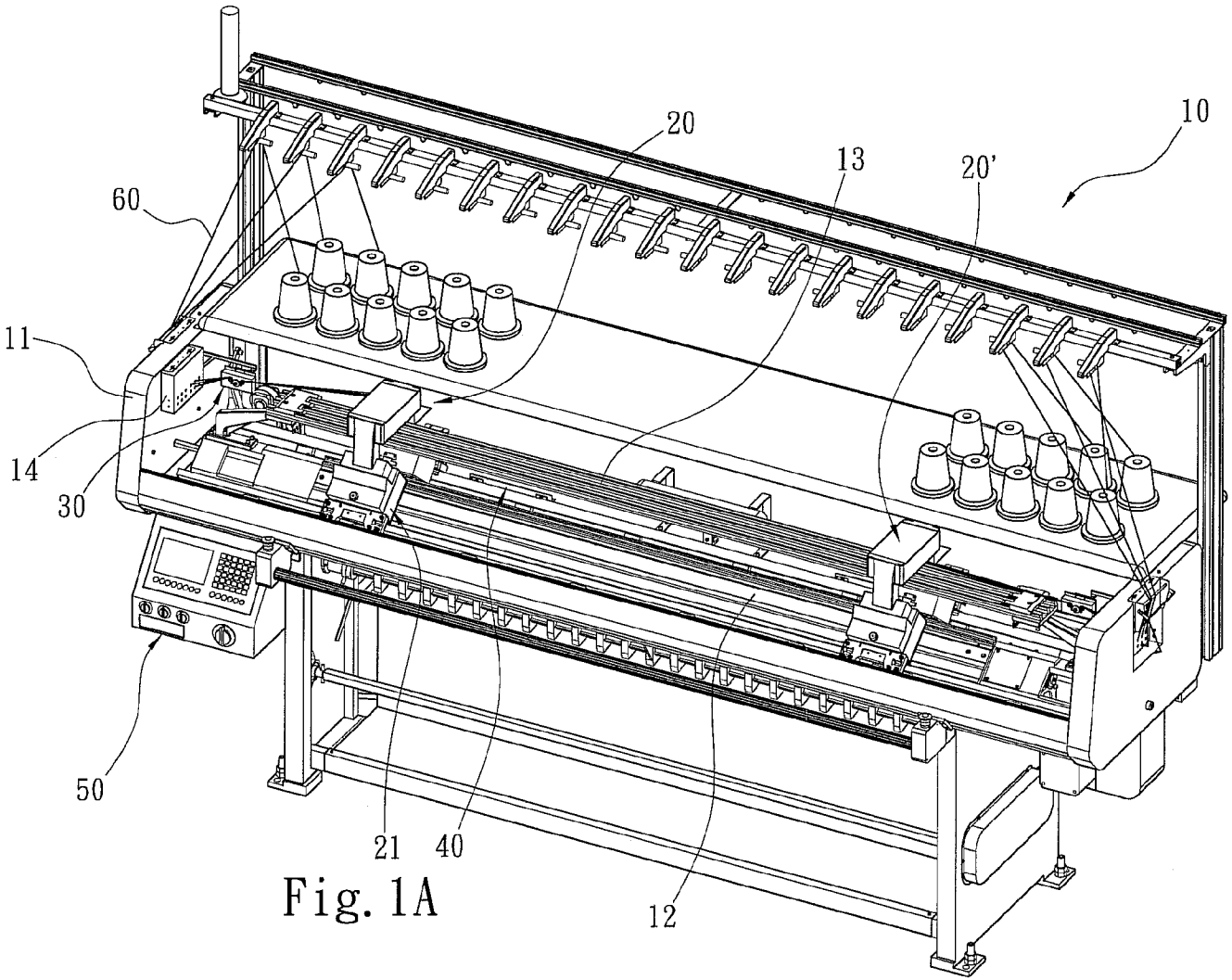
FIG. 1A is a perspective view of the invention.
Figure 1B:
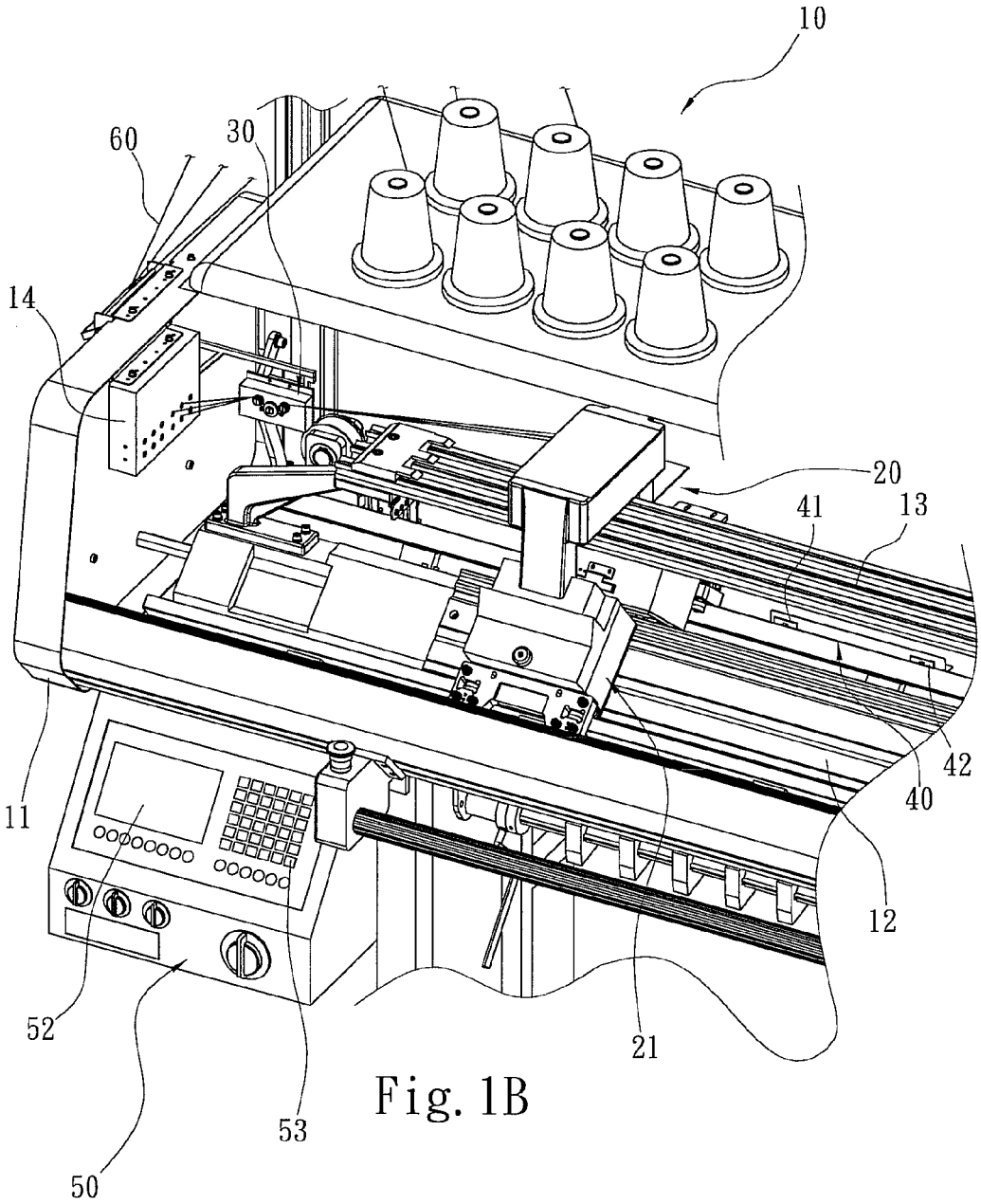
FIG. 1B is a fragmentary schematic view according to FIG. 1A.
Figure 2:
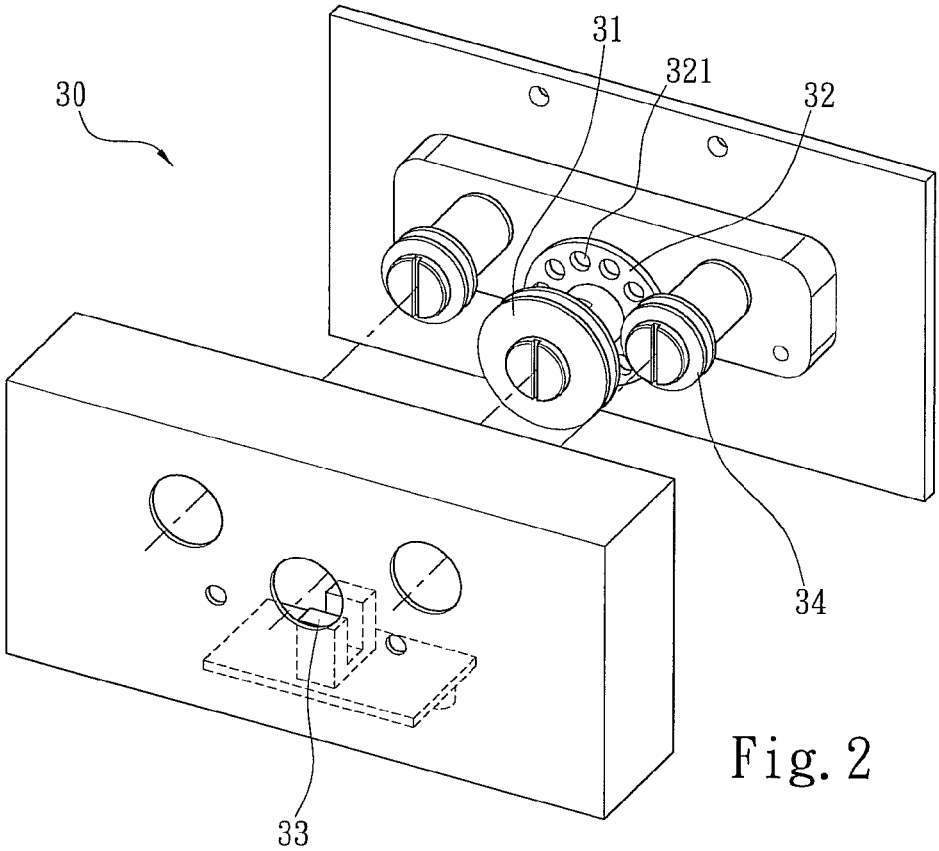
FIG. 2 is a fragmentary exploded view of the counter of the invention.
Figure 3:
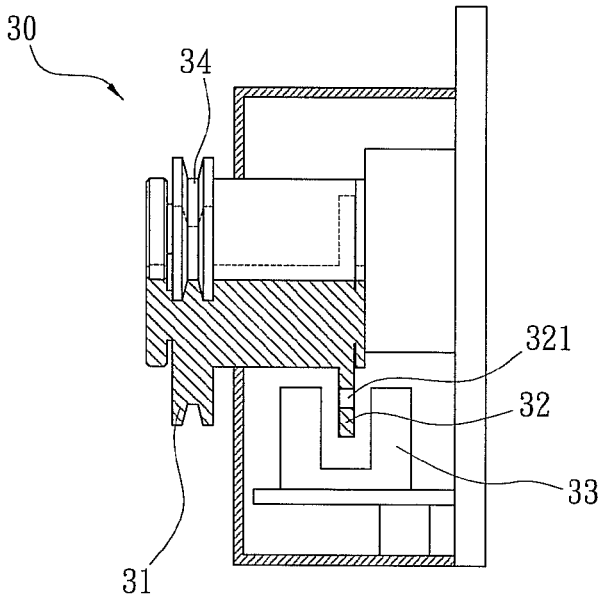
FIG. 3 is a fragmentary sectional view of the counter of the invention.
Figure 4A:
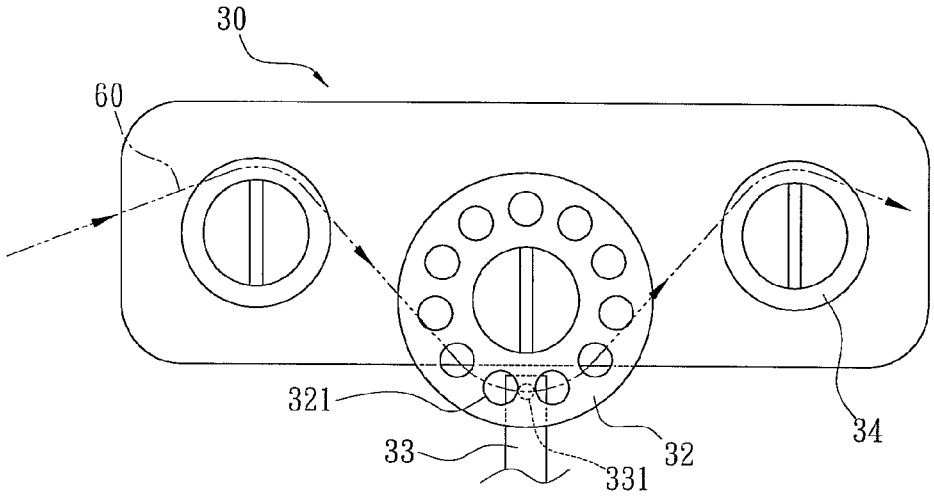
FIG. 4A is a schematic view of the counter of the invention in an operating condition.
Figure 4B:
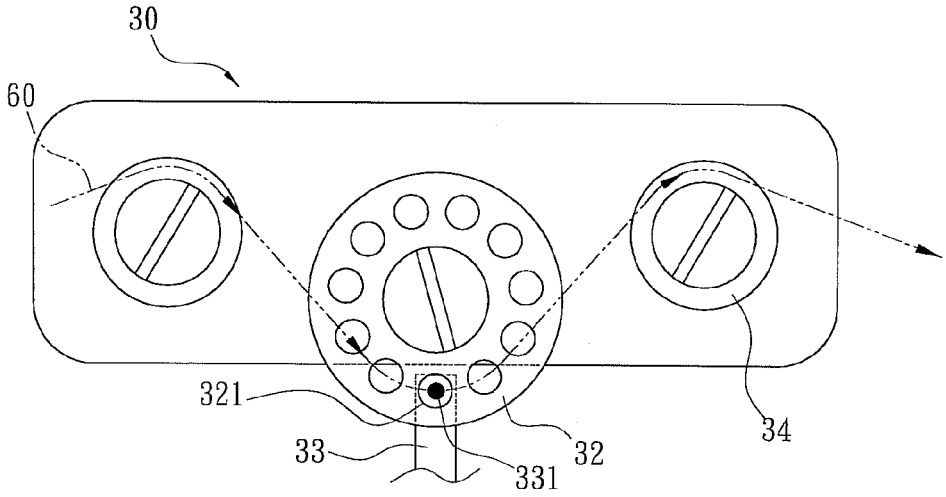
FIG. 4B is a schematic view according to FIG. 4A in an operating condition.
Figure 5:
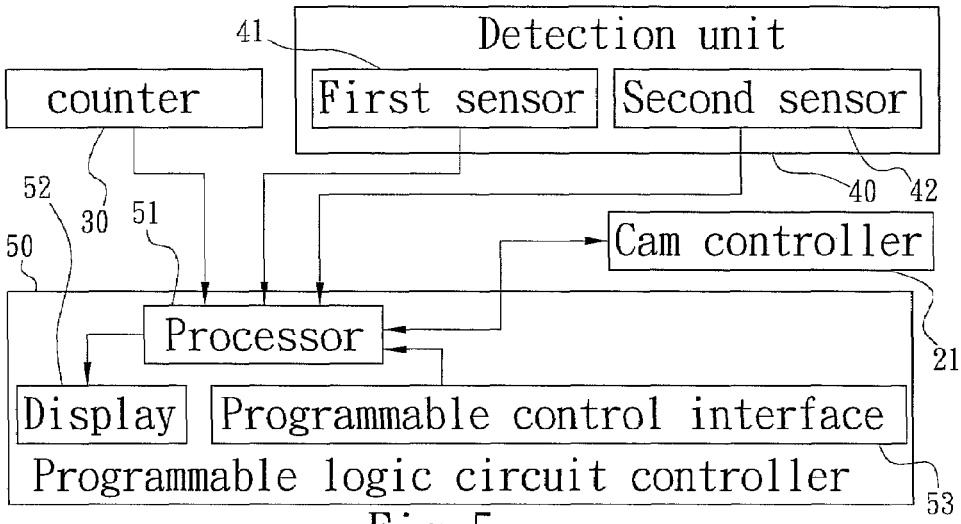
FIG. 5 is a block diagram of signal transmission of the invention.

Referring to FIGS. 4A and 4B, during operation a yarn 60 is continuously fed into the flat bed knitting machine 10. The yarn 60 and the circumferential surface of the primary wheel 31 of the counter 30 form a frictional contact. The yarn 60 continuously drives the primary wheel 31 and grating wheel 32 to rotate concurrently. The equally spaced apertures 321 on the grating wheel 32 allow a sensor spot 331 of the sensor 33 to receive light, while the opaque portions between the apertures 321 block the light from reaching the sensor spot 331. Hence the sensor 33 generates signals to the electrically connected processor 51. The error occurs to the yarn measuring device is resulted from the arched distance of the opaque portions (not shown in the drawings) between the apertures 321. If the contact length of the circumference of the primary wheel 31 and the yarn 60 decreases, the friction force is affected and slipping could occur. The invention, by providing the primary wheel 31 at a greater radius, not only a desired friction force can be maintained, also can control error value within a very small range. For instance, if the radius of the circumference of the primary wheel 31 in contact with the yarn 60 is 1.0 cm, according to the circumference equation of $L=2\pi r$, the contact length of the circumference between the primary wheel 31 and yarn 60 is about 6.28 cm. This circumferential length is divided by 11 apertures 321 to form 11 opaque portions. Hence the error value range occurred between two neighboring arched opaque portions is about 0 to 0.57 cm. Thus measuring accuracy improves significantly. In addition, the invention also provides the symmetrical ancillary wheels 34 at two sides of the grating wheel 32 to alter angles of feeding and exiting of the yarn 60 on the circumferential surface of the primary wheel 31, the stability of the yarn 60 on the circumferential surface of the primary wheel 31 also can be enhanced. And the contact length on the circumferential surface of the primary wheel 31 also can be increased. As a result, the friction force between the primary wheel 31 and year 60 is greater, and slipping can be prevented without affecting measurement accuracy.

Referring to FIGS. 7A to 7D, the rotation of the grating wheel 32 makes the sensor 33 to generate signals to the programmable logic circuit controller 50. But before the mask plate 212 blocking the detection unit 40, the programmable logic circuit controller 50 does not receive the signals, nor starts accumulation. After the mask plate 212 blocks the first sensor 41, the first sensor 41 issues a signal to the programmable logic circuit controller 50 which receives the signal continuously generated by the counter 30 and starts accumulation. When the carriage 20 continuously moves and the mask plate 212 also moves for the selected distance X to the second sensor 42 (may be the distance of 100 needles), the second sensor 42 issues another signal to the programmable logic circuit controller 50 to stop receiving the signal from the counter 30 and also stops accumulation. Meanwhile, the accumulated signals have been processed by the processor 51 of the programmable logic circuit controller 50, and stored in a buffer (not shown in the drawings) of the programmable logic circuit controller 50, and also is displayed on the display 52. Because the carriage 20 moves continuously until to a width entered in advance through the programmable control interface 53, a reverse movement occurs. Then a feedback signal of the reverse movement is generated to reset the processor 51. Due to the sensor 33 continuously generates the signals caused by continuous rotation of the grating wheel 32 driven by the feeding of yarn 60, before the mask plate 212 blocking the detection unit 40 the programmable logic circuit controller 50 does not receives nor starts accumulation. After the mask plate 212 has blocked the second sensor 42, the second sensor 42 issues another signal to the programmable logic circuit controller 50 to start receiving and accumulating the signals generated by the counter 30. When the carriage 20 continuously moves and the mask plate 212 is moved to the first sensor 41, the first sensor 41 issues the signal to the programmable logic circuit controller 50 which stops receiving and accumulating the signal issued by the counter 30. The accumulated signals are processed by the processor 51 and saved in another buffer (not shown in the drawings) of the programmable logic circuit controller 50, and the result is displayed separately for another direction different from the one previously discussed on the display 52. Thus a bidirectional measurement can be accomplished. Moreover, as the programmable logic circuit controller 50 is located at one side of the chassis 11 without being moved with the carriage 20, the measured values on the display 52 can be read easily. In short, the yarn measuring device of the invention makes reading of the measured values easier during operation. Moreover, as the programmable logic circuit controller 50 is located at one side of the chassis 10, data can be directly entered through the programmable control interface 53 to make adjustment of the position of the cams of the cam controller 21 easier and more efficient.

As the grating wheel 32 is driven by continuous feeding of the yarn 60 and generates light blocking signals to be received and accumulated by the programmable logic circuit controller 50, and the processor 51 processes total amount of the yarn 60 being consumed (derived by multiplying the arched distance of the opaque portions of the grating wheel 32 and total accumulated signals being received) through the selected distance X (for 100 needles), or yarn consumption of each stitch of each needle can be converted by dividing with 100, hence the stitch size can be determined, and the cam can be adjusted to a higher or lower position accordingly. Also referring to FIG. 1A, in order to increase production yield, another carriage 20' may be added to the flat bed knitting machine 10. The additional carriage 20' also can be controlled as previously discussed to produce fabrics of the same quality, width and amount, and total consumption of the yarn can be calculated accurately, and fabric quality can be improved and production efficiency can be enhanced.

While the preferred embodiments of the invention have been set forth for the purpose of disclosure, modifications of the disclosed embodiments of the invention as well as other embodiments thereof may occur to those skilled in the art.

Accordingly, the appended claims are intended to cover all embodiments which do not depart from the spirit and scope of the invention.

What is claimed is:

1. A yarn measuring device for a flat bed knitting machine which has a chassis, a needle bed located horizontally on the chassis, a track located above the needle bed and in parallel therewith, and a carriage straddled the track and movable horizontally thereon and having two ends each fastened respectively to a cam controller and a mask plate located at one end thereof, the yarn measuring device comprising:

a counter which is located on the chassis close to a distal end of the track and has an axial grating wheel which has a plurality of apertures formed in a circular array and equally spaced manner and a primary wheel and an U-shaped sensor, the grating wheel being extended between two ends of the sensor;

a detection unit which is located on the chassis in parallel with the needle bed and opposing the mask plate and has a first sensor and a second sensor spaced from each other at a selected distance in an U shape; and a programmable logic circuit controller which is located at one side of the chassis and has a processor, a display and a programmable control interface that are electrically interconnected, the programmable logic circuit controller, the counter, the detection unit, the carriage and the cam controller being electrically interconnected.

2. The yarn measuring device of claim 1, wherein the cam controller has cams.

3. The yarn measuring device of claim 2, wherein the primary wheel is interposed between symmetrical ancillary wheels at two sides thereof.

4. The yarn measuring device of claim 3 further having a yarn dispenser located on the chassis between the chassis and the counter.

* * * * *